United States Patent [19]

Stedman

[11] 3,935,953

[45] Feb. 3, 1976

[54] IMPLEMENT MOUNTING MEANS FOR EARTHWORKING VEHICLES

[75] Inventor: Robert N. Stedman, Chillicothe, Ill.

[73] Assignee: Caterpillar Tractor Co., Peoria, Ill.

[22] Filed: June 24, 1974

[21] Appl. No.: 482,503

[52] U.S. Cl. ..... 214/145 A; 172/272

[51] Int. Cl.² ..... E02F 3/81

[58] Field of Search ..... 214/145, 131 A, 620, 515; 172/272; 37/117.5; 74/520

[56] References Cited

UNITED STATES PATENTS

| | | | |
|---|---|---|---|
| 2,684,510 | 7/1954 | Muller | 74/520 |
| 3,338,609 | 8/1967 | Banas | 74/520 |
| 3,409,316 | 11/1968 | Jewell | 74/520 |
| 3,794,195 | 2/1974 | Clevenger et al. | 214/145 |
| 3,818,551 | 6/1974 | Coughran, Jr. | 214/145 |

*Primary Examiner*—Robert G. Sheridan
*Assistant Examiner*—Ross Weaver
*Attorney, Agent, or Firm*—Phillips, Moore, Weissenberger Lempio & Strabala

[57] ABSTRACT

An earthworking vehicle, such as a wheel loader, comprises a pair of lift arms mounted on a forward end thereof. A tilt linkage is interconnected between each lift arm and a loader bucket for selectively moving the loader bucket relative to the lift arms. The tilt linkage comprises mounting means, including an over-center toggle mechanism, releasably attached to the loader bucket whereby various work implements may be substituted in lieu thereof.

12 Claims, 5 Drawing Figures

12
10
16
11
15
14
20
IV
13
28
29
18
21
19
P1
24
25
27
V
P3
26
V
22
32
17
23
IV
30
P2
L
31

14
20
29'
29
12
28
21
P1
27
26
19
24
P3
34
17
23
25
22
P2
40
L
31'
30
31

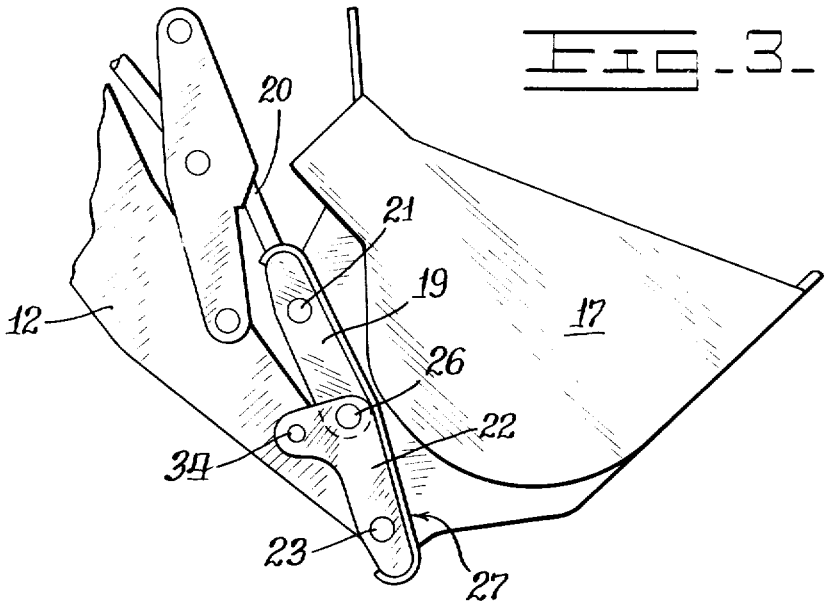
FIG. 3
FIG. 4
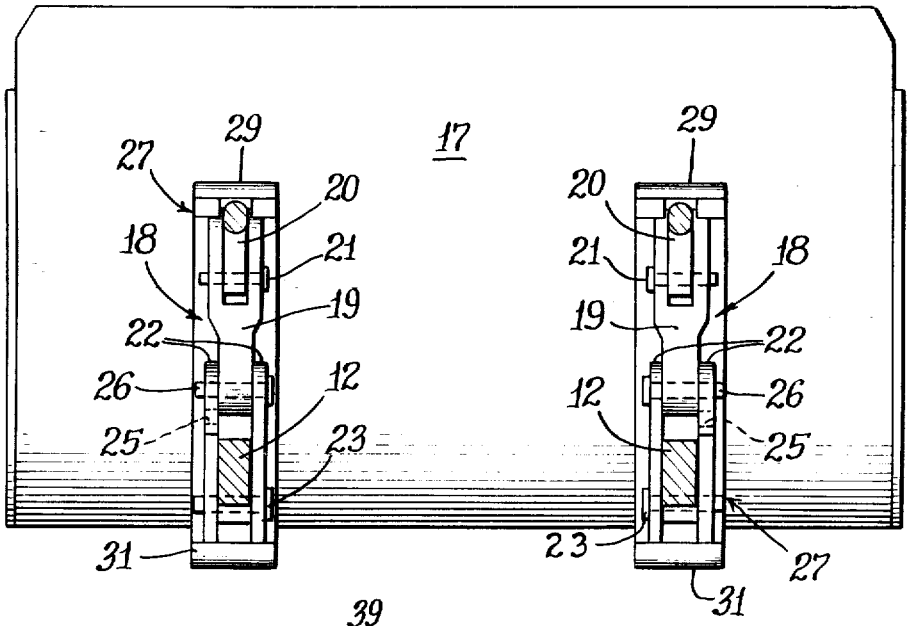
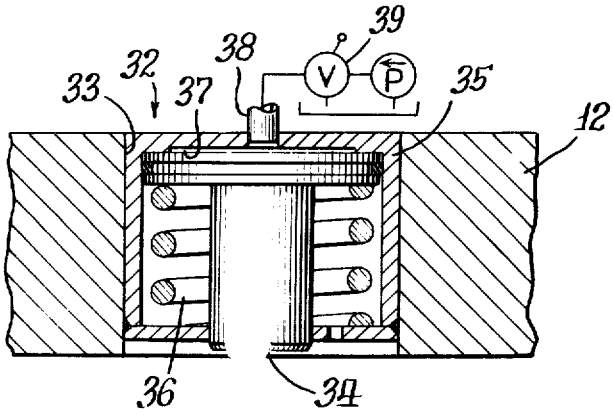
FIG. 5

IMPLEMENT MOUNTING MEANS FOR EARTHWORKING VEHICLES

BACKGROUND OF THE INVENTION

The versatility of certain earthworking vehicles, such as wheel loaders, has given rise to the need for quick disconnect and attachment mechanisms whereby various work implements may be attached to the vehicle. For example, the scope of work tasks performed by a wheel loader is greatly increased when it is adapted for use with a multiplicity of work implements. Typical vehicles of this type are disclosed in U.S. Pat. Nos. 3,243,066; 3,417,886; 3,543,863; and 3,760,883.

The popularity of such vehicles is primarily due to the fact that they can be expeditiously transported between job sites for application of alternate work implements thereon. Such versatility greatly increases the overall utility and productivity of the vehicles to thus substantially increase their economic worth. Conventional disconnect and attachment mechanisms for such vehicles are normally complicated, require special tooling and skills and oftentimes further require additional frame structures which substantially increase the dead weight at the front of the vehicle.

SUMMARY OF THIS INVENTION

An object of this invention is to overcome the above, briefly described problems by providing an economical and non-complex mounting means for expeditiously changing work implements on a vehicle. The vehicle comprises a frame having implement support means, such as a pair of lift arms, mounted thereon. The mounting means includes at least one over-center toggle mechanism for releasably attaching a work implement on the support means.

BRIEF DESCRIPTION OF THE DRAWINGS

Other objects of this invention will become apparent from the following description and accompanying drawings wherein:

FIG. 3 is a view similar to FIG. 2, but showing a toggle mechanism of the mounting means in its over-center position to attach the loader bucket thereon;

FIG. 4 is a back side elevational view, taken in the direction of arrows IV—IV in FIG. 1; and FIG. 5 is an enlarged sectional view, taken in the direction of arrows V—V in FIG. 1 and further schematically showing a fluid control circuit associated therewith.

DETAILED DESCRIPTION

Figure 1:
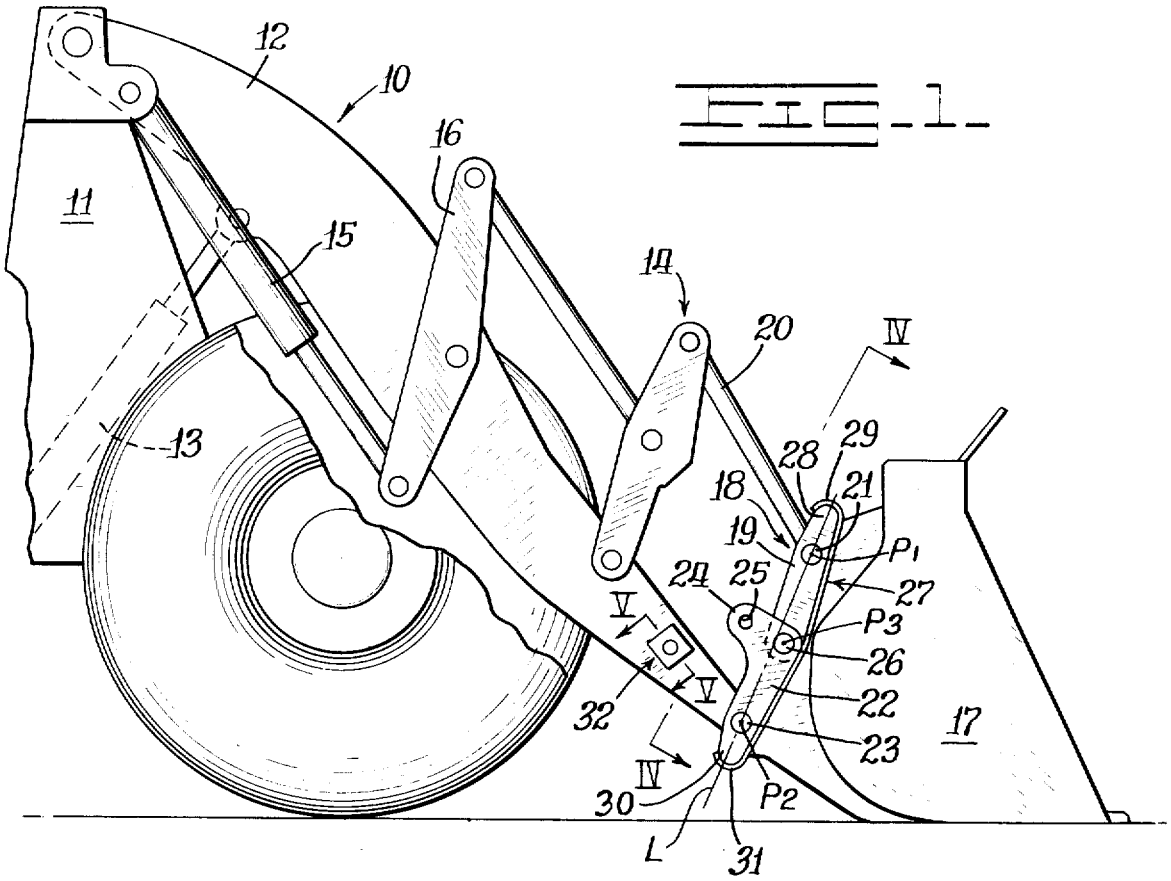
FIG. 1 is a side elevational view of a front portion of a wheel loader employing the mounting means of this invention thereon.

FIG. 1 partially illustrates an earthworking vehicle 10, such as a wheel loader, comprising a frame 11 having a pair of support means or lift arms 12 (one shown) pivotally mounted on a forward end thereof. A double-acting hydraulic cylinder 13 is pivotally interconnected between the frame and each lift arm for selective raising and lowering purposes. A parallelogram type tilt linkage 14 is pivotally mounted on each lift arm and is adapted to be actuated by a double-acting hydraulic cylinder 15 pivotally interconnected between a bellcrank 16 of the tilt linkage and frame 11.

A work implement, such as a loader bucket 17, is mounted on the forward end of each lift arm by mounting means comprising the tilt linkage and an over-center toggle mechanism 18. The mechanism comprises a first link 19 attached at its outer, bifurcated end (FIG. 4) to a rod 20 of the tilt linkage by a first pivot means or pin 21 and a second pair of links 22 attached at their outer ends to a forward end of lift arm 12 by a second pivot means or pin 23. Each outer second link has a rearward extension 24 formed integrally thereon and an aperture 25 is formed therethrough for purposes hereinafter explained.

As further shown in FIG. 1 and 4, the inner blade end of first link 19 is connected between the inner ends of second links 22 by a third pivot means or pin 26 which is shown as having its pivot axis $P_3$ in over-center relationship with respect to an imaginary line L intersecting pivot axes $P_1$ and $P_2$ of pins 21 anad 23, respectively. The bucket has a pair of generally U-shaped brackets 27 secured on a back side thereof to accommodate expanded links 19 and 22 therein. In particular, an outer arcuate end 28 of first link 19 is locked into a like-shaped hook portion 29 formed on an upper end of the bracket whereas outer arcuate ends 30 of second links 22 engage a like-shaped hook portion 31 formed on a lower end of the bracket. Each bracket preferably comprises a spring steel or like resilient material which will permit hook portions 29 and 31 to expand slightly to their respective 29' and 31' phantom line positions in FIG. 2 when engaged by the over-centered toggle mechanism.

Referring to FIGS. 1 and 5, a remotely controlled locking mechanism 32 is mounted as a cartridge in a bore 33 formed in each lift arm. The locking mechanism comprises a piston-type detent 34 reciprocally mounted in a vented housing 35 thereof and normally spring-biased to a retracted position by a compression coil spring 36. As will be hereinafter more fully described, a closed actuating chamber 37, formed between the head end of the detent and a fluid inlet 38, is adapted to by pressurized with a fluid, such as air or oil, under the control of a three-way control valve 39 to selectively extend the detent into aperture 25 formed on an outer second link 22 (FIG. 2) to provide cooperative locking means therewith.

Figure 2:
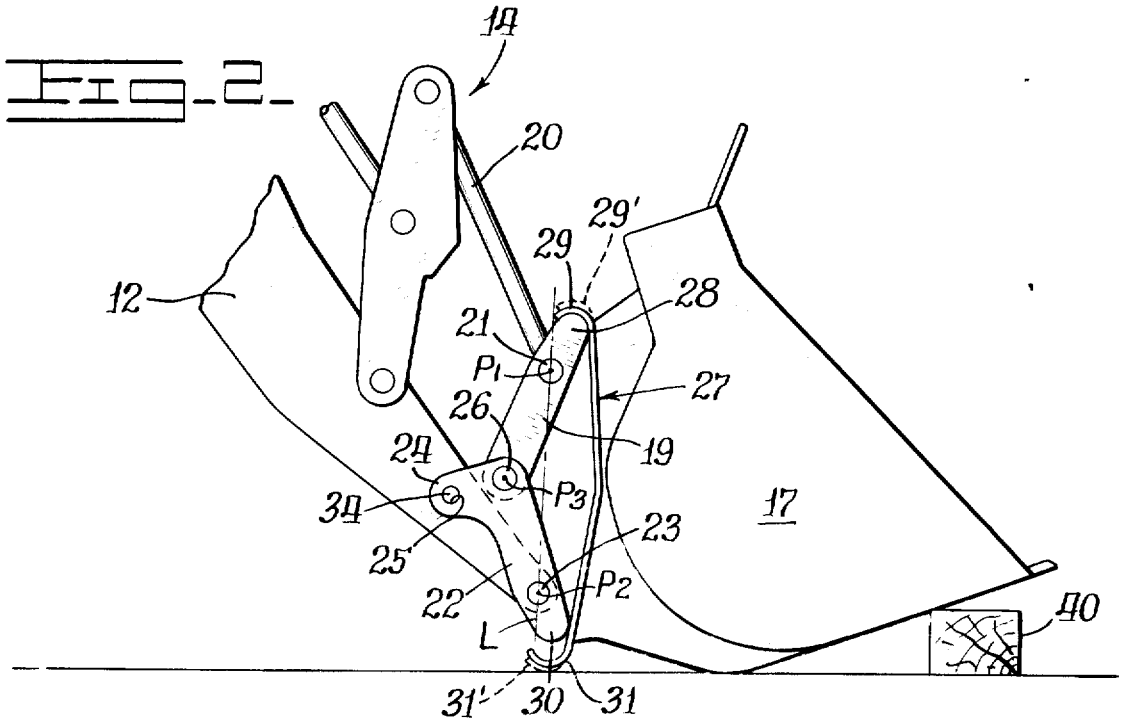
FIG. 2 is a side elevational view of the mounting means, but showing it during release of a loader bucket therefrom.

When it is desired to detach loader bucket 17 from the vehicle, cylinders 15 are extended to position the loader bucket in its racked-back condition, illustrated in FIG. 3. Control valve 39 of the fluid pressure control means (FIG. 5) is then actuated to extend detents 34 into engagement with respective apertures 25. As shown in FIG. 2, a stationary block 40 may be positioned at a forward end of the bucket to aid in the bucket release function upon retraction of cylinders 15. With second links 22 secured in place to the lift arms, each first link 19 will thus pivot clockwise about pin 26 to draw the toggle mechanism into an under-center condition wherein pivot axis $P_3$ of pin 26 moves rearwardly of imaginary line L intersecting pivot axes $P_1$ and $P_2$ of pins 21 and 23, respectively.

An alternate work implement (not shown) may then be substituted in lieu of loader bucket 17 by substantially reversing the above procedure. In particular, upper ends 28 of each of first links 19 would be first positioned to engage a hook portion of a respective bracket 27 secured on the alternate implement. Such position would be substantially that shown in FIG. 2. Control valve 39 (FIG. 5) would then be actuated to depressurize chambers 37 whereby coil springs 36 would function to retract detents 34 from apertures 25 of second links 22.

Retraction of cylinders 15 would then function to move the toggle mechanisms into their expanded and over-center FIG. 1 positions. Ends 28 and 30 of links 19 and 22, respectively, would then firmly engage their respective hooked portions. As discussed above, the hooked portions are preferably forced apart slightly, due to their inherent resiliency, to clamp the alternate implement firmly in place.

I claim:

1. A vehicle adapted to have a work implement releasably attached thereon comprising a frame, implement support means, including lift arm means and tilt linkage means, mounted on said frame, and mounting means, including at least one over-center toggle mechanism, mounted on said support means and interconnected between the lift arm means and tilt linkage means thereof for releasably attaching a work implement on said support means, said toggle mechanism comprising a pair of first and second links pivotally connected together at inner ends thereof at a common pivot means, an outer end of said first link being pivotally connected to said tilt linkage means and an outer end of said second link being pivotally mounted on said lift arm means.

2. The vehicle of claim 1 wherein said left arm means comprises a pair of laterally spaced lift arms pivotally mounted on said frame and means operatively interconnected between said frame and each of said lift arms for selectively raising and lowering said lift arms.

3. The vehicle of claim 2 further comprising a work implement releasably attached to each of said lift arms by one of said mounting means.

4. The vehicle of claim 3 wherein said work implement constitutes a loader bucket.

5. The vehicle of claim 3 wherein said tilt linkage means comprises a tilt linkage mounted on each of said lift arms and means operatively connected between said frame and each of said tilt linkages for selectively tilting said work implement relative to said lift arms, one of said over-center toggle mechanisms pivotally interconnected between forward ends of a respective tilt linkage and lift arm.

6. The vehicle of claim 5 wherein said work implement has a pair of generally U-shaped brackets secured on a backside thereof and wherein one of said toggle mechanisms is expanded into locked engagement with each one of said brackets.

7. The vehicle of claim 1 further comprising cooperative locking means on said second link and on said implement support means for selectively locking said second link to said implement support means to prevent relative motion therebetween, whereby the toggle mechanism may be released by operating said tilt arm means in a dump direction.

8. The vehicle of claim 7 wherein said locking means comprises an aperture formed in said second link and a detent reciprocally mounted on said implement support means.

9. The vehicle of claim 8 further comprising means for selectively retracting or extending said detent into engagement with said aperture.

10. The vehicle of claim 9 wherein said lastmentioned means comprises spring means engaging said detent for normally retracting the same and fluid pressure control means for selectively extending said detent.

11. The vehicle of claim 1 further comprising a work implement and at least one generally U-shaped bracket secured on a back side of said work implement, said bracket having a hook portion formed on each end thereof, and wherein an outer end of each of said first and second links is disposed in locked engagement within a respective one of said hook portions.

12. The vehicle of claim 1 wherein said tilt linkage means comprises a parallelogram-type tilt linkage and wherein said over-center toggle mechanism is operatively interconnected between said tilt linkage and said support means.

* * * * *